US006502849B1

(12) United States Patent
Kamiakito et al.

(10) Patent No.: US 6,502,849 B1
(45) Date of Patent: Jan. 7, 2003

(54) SKID PLATE

(75) Inventors: Shinji Kamiakito, Tokyo-To (JP); Atsuhiko Sakabe, Tokyo-To (JP); Nobuyuki Mori, Tokyo-To (JP); Hajime Kasai, Toyko-To (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/242,472

(22) PCT Filed: Jun. 19, 1998

(86) PCT No.: PCT/JP98/02738

§ 371 (c)(1),
(2), (4) Date: Feb. 18, 1999

(87) PCT Pub. No.: WO98/58709

PCT Pub. Date: Dec. 30, 1998

(30) Foreign Application Priority Data

Jun. 20, 1997 (JP) ..... 9-164023

(51) Int. Cl.[7] ..... A63C 5/12
(52) U.S. Cl. ..... 280/610; 280/608
(58) Field of Search ..... 280/14.22, 601, 280/608, 602, 609, 610, 607, 617, 636, 11.14; 428/309.9

(56) References Cited

U.S. PATENT DOCUMENTS

| | | | | | |
|---|---|---|---|---|---|
| 3,738,675 | A | * | 6/1973 | Hashimoto | 280/610 |
| 4,068,861 | A | * | 1/1978 | Zemke, Jr. | 280/610 |
| 4,647,063 | A | * | 3/1987 | Piringer et al. | 280/610 |
| 4,928,989 | A | * | 5/1990 | Mayr et al. | 280/610 |
| 5,141,243 | A | * | 8/1992 | Meatto | 280/602 |
| 5,197,752 | A | * | 3/1993 | Engelbert et al. | 280/610 |
| 5,292,148 | A | * | 3/1994 | Abondance et al. | 280/602 |
| 5,678,841 | A | * | 10/1997 | Bauvois | 280/608 |
| 5,687,983 | A | * | 11/1997 | Feketa et al. | 280/609 |
| 5,720,118 | A | * | 2/1998 | Mayer et al. | 36/107 |
| 5,792,552 | A | * | 8/1998 | Langkamp et al. | 428/309.9 |
| 5,924,718 | A | * | 7/1999 | Gordon et al. | 280/610 |

FOREIGN PATENT DOCUMENTS

| | | |
|---|---|---|
| JP | 52-132936 | 11/1977 |
| JP | 4-164467 | 6/1992 |
| JP | 8-24733 | 3/1996 |

OTHER PUBLICATIONS

Patent Abstracts of Japan, No. 52132936 A to Keisuki dated Nov. 11, 1977.
Patent Abstracts of Japan, No. 04164467 A to Hiroshi, et al. dated Jun. 10, 1992.

* cited by examiner

*Primary Examiner*—Brian L. Johnson
*Assistant Examiner*—Hau Phan
(74) *Attorney, Agent, or Firm*—Smith, Gambrell & Russell, LLP

(57) ABSTRACT

A gliding board has a core structure (11) constructed by bonding flat plates (14, 15) to top and bottom surfaces of a core member (13) of the shape of a rectangular or trapezoidal waveform waving forwardly and rearwardly in the longitudinal direction of the board. The gliding board has a similar longitudinal bending rigidity compared to those of the conventional gliding boards, a relatively small longitudinal torsional/bending rigidity ratio and a high lateral bending rigidity.

11 Claims, 5 Drawing Sheets

SKID PLATE

TECHNICAL FIELD

The present invention relates to a gliding board, such as a snowboard, a ski or the like.

BACKGROUND ART

A known snowboard or ski has a core structure constructed by bonding fiber-reinforced plastic members reinforced by glass fibers, aramid fibers, carbon fibers or boron fibers, or metal members of a light metal, such as titanium or aluminum, to a core member of a synthetic resin, such as a foam urethane resin, or of composite wood.

A ski disclosed in JP-A No. 52-132936 is constructed by filing alternate upper and lower spaces formed in a corrugated core member waving in variable amplitude according to the thickness distribution of the ski with a synthetic resin, and by bonding a top surface member and a bottom surface member to the core member.

JP-B No. 8-24733 discloses a ski having a fiber-reinforced resin core structure constructed by applying a synthetic resin to a three-dimensional fabric core member which consists of flat fabric plate weavingly attached to a corrugated fabric member having round ridges and round furrows or having walls arranged in successive X-shapes, and discloses a ski having a core structure formed by filling voids in the foregoing fiber-reinforced plastic core structure with a lightweight plastic material, such as a foam urethane resin or a foam epoxy resin.

The known snowboard or ski has a core structure constructed by bonding fiber-reinforced plastic members reinforced by glass fibers, aramid fibers, carbon fibers or boron fibers, or metal members of a light metal, such as titanium or aluminum, to the core member of a synthetic resin, such as a foam urethane resin, or of composite wood and has sufficient longitudinal rigidity and longitudinal strength. However, sufficient consideration is not given to lateral rigidity and lateral strength of the snowboard.

The snowboard has a width twice wider than that of the ski, a relatively thin peripheral part and a relatively thick central part. Therefore sufficient consideration must be given to lateral rigidity and lateral strength of the snowboard to secure stable edge holding performance during curving.

When the snowboard is constructed with a core member made of synthetic resin, such as foam urethane resin, or composite wood, so as to secure sufficient longitudinal rigidity and longitudinal strength, the lateral torsional rigidity of the snowboard becomes very high, and it spoils a contacting performance of the snowboard for maintaining intimate contact with the undulations of the snow surface.

The ski disclosed in JP-A No. 52-132936 has a core structure formed by bonding a top plate and a bottom plate to the upper and the lower edges of the triangular ridges of a core member of a triangular waveform formed by working a plate of a light metal, such as aluminum, or a plastic, such as an ABS resin (acrylonitrile butadiene styrene resin). Therefore, it is difficult to secure a sufficiently large bonding area on the corrugated core member for the top and the bottom plate, and bonding strength bonding together the top plate and the core member and the bottom plate and the core member is insufficient. Therefore, spaces between the top plate and the core member and those between the bottom plate and the core member are filled up with a synthetic resin to secure a sufficient bonding strength, which, however, increases the weight of the ski and makes it difficult to design the ski so that the ski has sufficient rigidity.

The ski disclosed in JP-B No. 8-24733 has a sufficient bonding strength by weavingly attaching the flat fabric plate to the corrugated fabric member. However, application of a synthetic resin to the three-dimensional fabric core member results in the dispersion of the rigidity of the ski, because the synthetic resin can not penetrate enough of thick fabric plate or the thick corrugated fabric. On the contrary, when the fabric plate and the corrugated fabric are made thinner to avoid the dispersion of the rigidity of the ski, the rigidity and/or the strength of the ski become smaller.

The present invention has been made in view of those problems, and it is therefore an object of the present invention to provide a gliding board which has stable edge holding performance and stable gliding performance by having a small torsional/longitudinal bending rigidity ratio and a high lateral bending rigidity, while having a similar longitudinal bending rigidity compared to those of conventional snowboards and skis.

DISCLOSURE OF THE INVENTION

A gliding board in accordance with the present invention has a core structure which consists of a core member of the shape of a rectangular or trapezoidal waveform waving forwardly and rearwardly in the longitudinal direction of the gliding board, a top flat plate and a bottom flat plate bonded to the top surface and the bottom surface of the core member respectively. By this construction, the gliding board has a small torsional/longitudinal bending rigidity ratio and a high lateral bending rigidity while having a similar longitudinal bending rigidity compared to that of the conventional gliding board, which generate stable edge holding performance during curving and stable gliding performance.

Since the core member has laterally extending rectangular or trapezoidal ridges and furrows, a large bonding area is available for bonding both the plates to the surfaces of the core member.

Accordingly, the core member and the plates can easily be bonded together with a high bonding strength.

In the gliding board of the present invention, the heights of the rectangular or trapezoidal ridges and furrows of the core member may be formed depending on the thicknesses of the various parts of the gliding board in the longitudinal direction. And, this characteristic provides a central part of the gliding board on which a large load is exerted with a high rigidity so that the central part may not be bent greatly and can, distribute the load properly on the snow surface. Also, this characteristic provides both longitudinal ends of the gliding board with a bending rigidity and a torsional rigidity lower than those of the central part so that the gliding board is capable of contacting with the undulations of the snow surface.

The fine adjustment of the longitudinal bending rigidity, the torsional rigidity and the lateral bending rigidity of the gliding board of the present invention can be achieved by longitudinally arranging the rectangular or trapezoidal ridges at different pitches.

The fine adjustment of the longitudinal bending rigidity and the torsional rigidity of the gliding board of the present invention can easily be achieved by wrapping a fiber-reinforced plastic member around and bonding the same to the core structure.

The fine adjustment of the longitudinal bending rigidity and torsional rigidity of the gliding board of the present invention can easily be achieved by bonding members of a synthetic resin to the opposite sides of the core structure.

BEST MODE FOR CARRYING OUT THE INVENTION

Preferred embodiments of the present invention will be described hereinafter with reference to the accompanying drawings.

Figure 1:
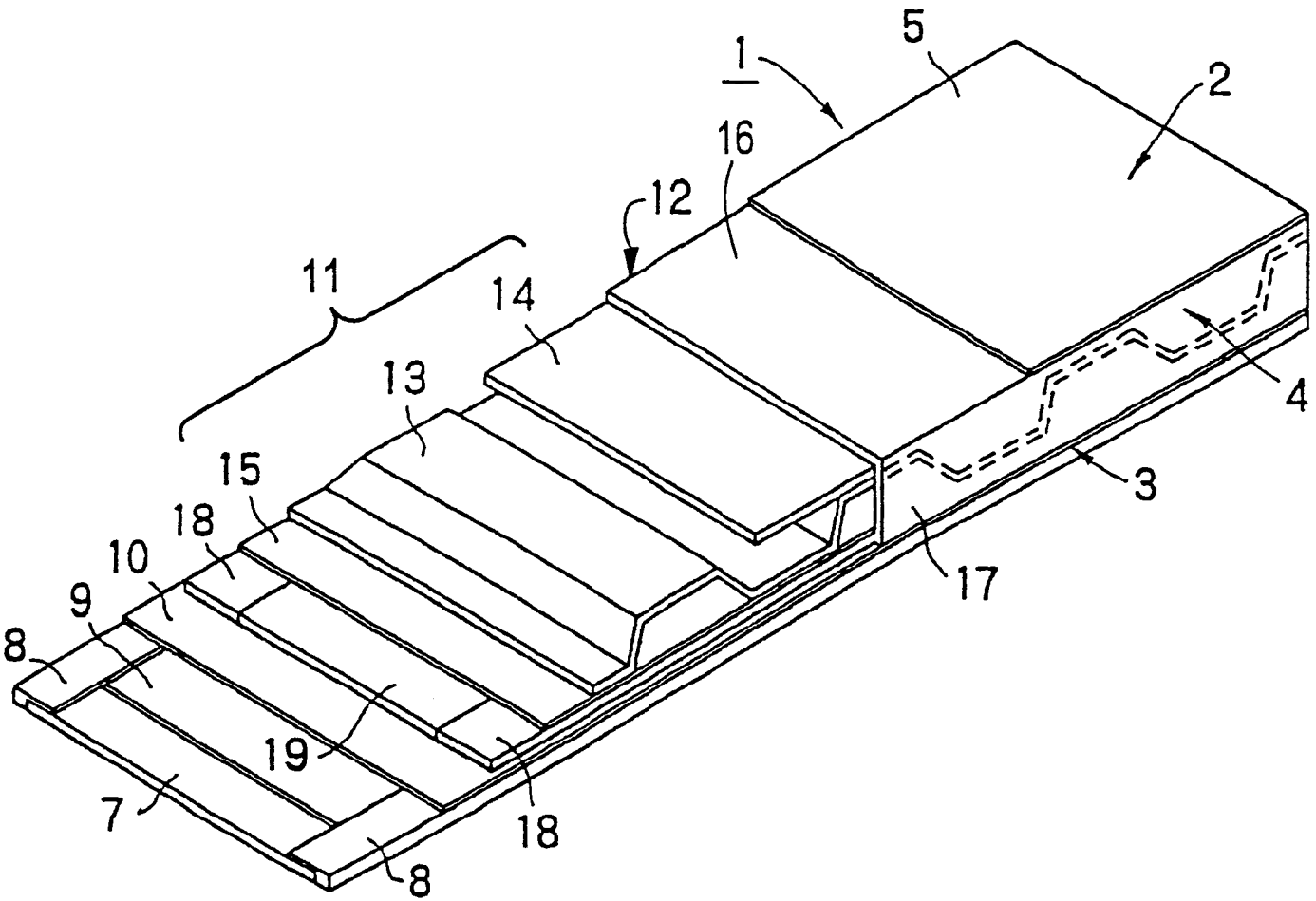
FIG. 1 is a partly removed perspective view of a gliding board in a first embodiment according to the present invention.

FIG. 1 is a perspective view of a gliding board in a first embodiment according to the present invention in the form of a snowboard, in which some parts of the snowboard 1 are removed for easy understanding of the construction of the snowboard 1.

The snowboard 1 comprises a top surface member 2, a sole structure 3, and a wrapped structure 4 sandwiched between the top surface member 2 and the sole structure 3.

The top surface member 2 is a flat plate of synthetic resin, such as an ABS resin, or a glass-fiber-reinforced plastic of a low rigidity having a low fiber density. The top surface member 2 includes a top surface wall 5.

The sole structure 3 comprises a sole member 7 formed from a high molecular weight polyethylene resin plate, steel edges 8 disposed on the opposite sides of the sole member 7, a spacer 9 of a glass-fiber-reinforced plastic placed between the edges 8 on the upper surface of the sole member 7, and a cushioning member 10 of a glass-fiber-reinforced plastic.

Figure 2:
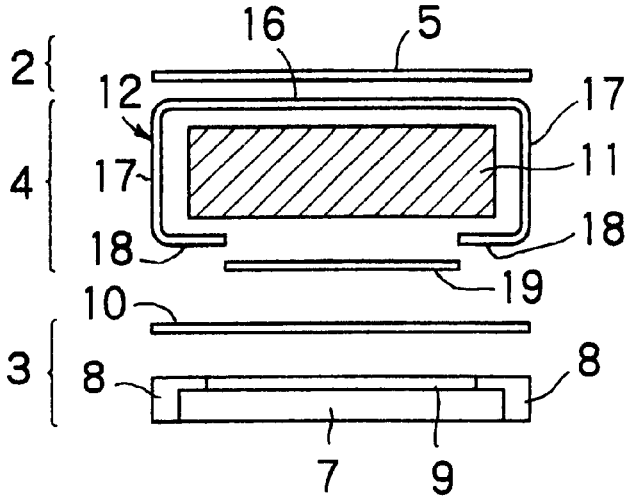
FIG. 2 is an exploded cross-sectional view of the gliding board of the present invention, showing a wrapped structure, a top surface member and a sole member.

As shown in FIG. 2, the wrapped structure 4 comprises a core structure 11, a wrapping member 12 wrapping around the core structure 11, and a bottom member 19.

As shown in FIG. 1, the core structure 11 comprises a core member 13 in the form of trapezoidal waveforms waving forwardly and rearwardly in the longitudinal direction of the snowboard, a top flat plate 14 bonded to the top surface of the trapezoidal waveforms of the core member 13, and a bottom flat plate 15 bonded to the bottom surface of the trapezoidal waveforms of the core member 13. The core member 13 is formed by working a flat plate of a fiber-reinforced plastic, such as a carbon-fiber-reinforced plastic, glass-fiber-reinforced plastic, an aramid-fiber-reinforced plastic or a boron-fiber-reinforced plastic, or a flat plate of a light metal, such as aluminum or titanium. The top plate 14 and the bottom plate 15 are flat plates of a fiber-reinforced plastic, such as a carbon-fiber-reinforced plastic, a glass-fiber-reinforced plastic, an aramid-fiber-reinforced plastic or a boron-fiber-reinforced plastic, or flat plates of a light metal, such as aluminum or titanium.

As shown in FIG. 2, the wrapping member 12 is made of a fiber-reinforced plastic, such as a carbon-fiber-reinforced plastic, a glass-fiber-reinforced plastic, an aramid-fiber-reinforced plastic or a boron-fiber-reinforced plastic, and consists of a top wall 16, a pair of side walls 17 and a pair of bottom walls 18. The bottom member 19 is interposed between the bottom walls 18 of the wrapping member 12.

As shown in FIG. 1, the core member 13 has the shape of a trapezoidal waveform waving forwardly and rearwardly in the longitudinal direction of the snowboard 1, i.e. the core member 13 has trapezoidal ridges and trapezoidal furrows alternately disposed in the longitudinal direction of the snowboard. The heights and the pitches of the trapezoidal ridges and trapezoidal furrows are determined on the basis of the required rigidity of a snowboard 1 to which the core member 13 is applied. For example, a snowboard or a ski has a tapered shape having a thickness decreasing from a relatively thick central part toward relatively thin end parts. Such a tapered shape can be defined by the core member 13. The lateral bending rigidity can be made uniform over the entire longitudinal length of the snowboard 1 by gradually reducing the longitudinal pitches of the trapezoidal ridges and trapezoidal furrows from the central part toward the both ends of the snowboard 1.

The core member 13 shown in FIG. 1 has the shape of a trapezoidal waveform, but the core member 13 may be formed in the shape of a rectangular waveform.

A method of fabricating the snowboard 1 will be described 20 below on an assumption that the core structure 11, the wrapping member 12 and the bottom member 19 are formed by molding fiber-reinforced plastics.

The soles structure 3 is fabricated by bonding the steel edges 8 to the sole member 7 formed by shaping a high molecular weight polyethylene resin sheet with an adhesive, bonding the spacer 9 of a glass-fiber-reinforced plastic to a region of the top surface of the sole member 7 between the steel edges 8 by an adhesive, and curing the adhesives at an ordinary temperature.

The bottom plate 15, the core member 13 and the top plate 14 are formed separately.

Figure 3:
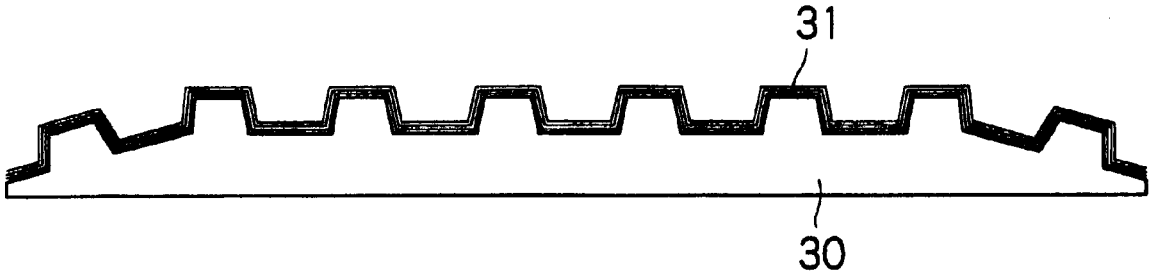
FIG. 3 is a sectional view of a core member included in the gliding board of the present invention as put on an upper half mold.
Figure 4:
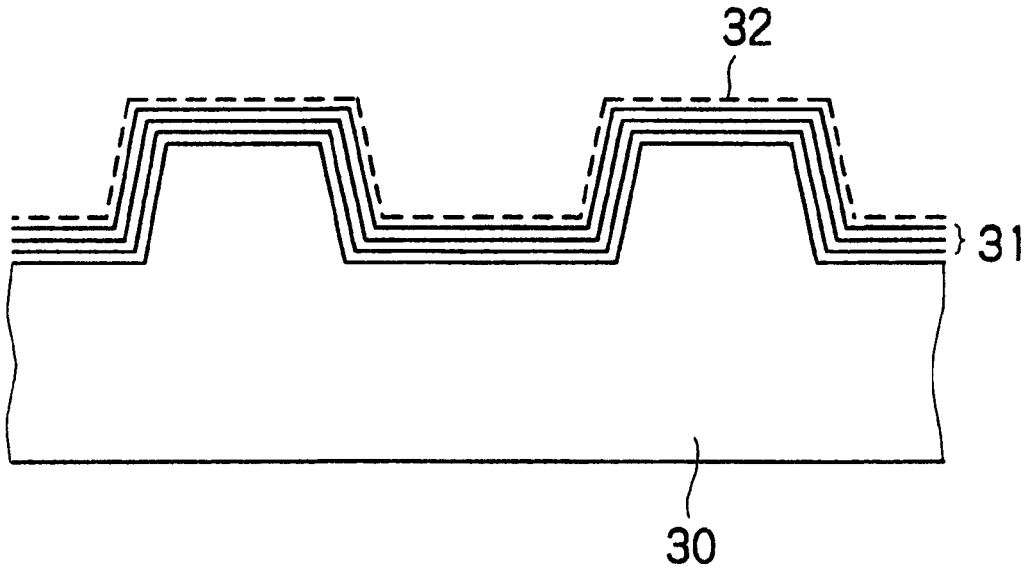
FIG. 4 is a sectional view used to assist in explaining a molding procedure for forming the core member shown in FIG. 3.

When forming the core member 13, as shown in FIG. 3, three prepeg sheets 31 are superposed on an inverted upper half mold 30 so that the prepreg sheets 31 conform to the wave surface of a trapezoidal waveform of the upper half mold 30. These prepreg sheets 31 are fabric prepreg sheets having fibers extending in the longitudinal direction of the snowboard and fibers extended in the lateral direction of the snowboard, i.e. perpendicular to the longitudinal direction (0°/90° fabric prepreg sheet). Then, as shown in FIG. 4, a vacuum bagging film 32 is put on the upper half mold 30 so as to cover the superposed prepreg sheets 31. In this case, any mold need not be placed on the vacuum bagging film 32. The vacuum bagging film 32 is placed loose over the superposed prepreg sheets 31 so that the vacuum bagging film 32 is able to conform to the surface of the prepreg sheets 31 when the prepreg sheets 31 are corrugated. Subsequently, a space covered with vacuum bagging film 32 is evacuated and the prepreg sheets 31 are heated for curing to produce the core member 13 having the shape of a trapezoidal waveform.

Figure 7:
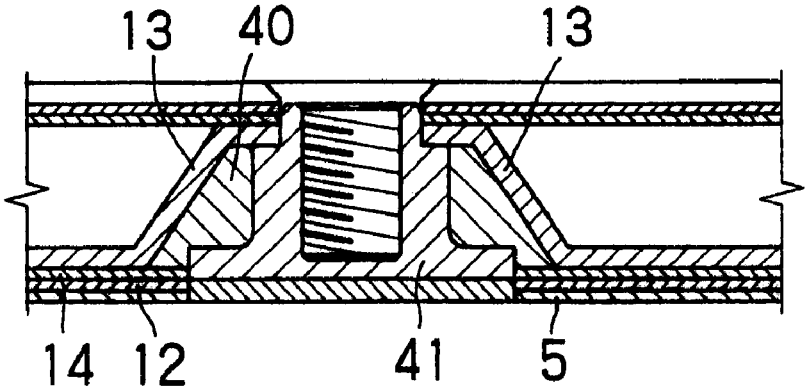
FIG. 7 is a sectional view of an anchor member holding part of the gliding board of the present invention.

Then, as shown in FIG. 7, a metal anchor member holding part is formed by filling a hollow defined by a predetermined trapezoidal ridge of the core member 13 of the shape of a trapezoidal waveform with a synthetic resin and heating the synthetic resin for curing. The metal anchor member holding part may be a holding member formed by molding the synthetic resin in a block of a necessary shape and heating the block for curing, and bonded to the predetermined trapezoidal ridge.

The top plate 14 of the core structure 11 is formed by placing a 0°/90° fabric prepreg sheet on an inverted upper half mold, not shown, superposing two unidirectional prepreg sheets having fibers extending in the longitudinal direction of the snowboard, superposing a 0°/90° fabric prepreg sheet on the two unidirectional prepreg sheets, covering the superposed prepreg sheets with a vacuum bagging film, evacuating a space covered with the vacuum bagging film, and heating the superposed prepreg sheets for curing.

The bottom plate 15 of the core structure 11 is formed by placing two 0°/90° fabric prepreg sheets on a lower half mold, not shown, covering the superposed prepreg sheets with a vacuum bagging film, evacuating a space covered with the vacuum bagging film, and heating the superposed prepreg sheets for curing.

Figure 5:
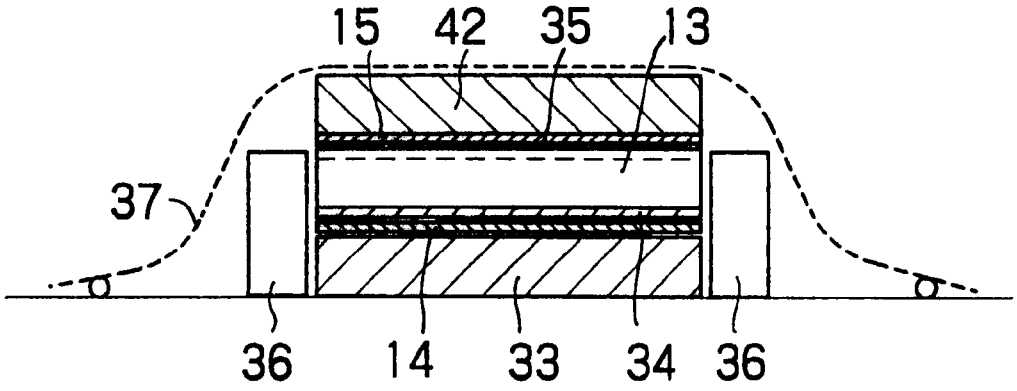
FIG. 5 is a sectional view used to assist in explaining a molding procedure for forming a core structure included in the gliding board of the present invention.

Then, as shown in FIG. 5, the top plate 14 is placed on an inverted upper half mold 33, the core member 13 is placed on the top plate 14 with an adhesive layer 34 sandwiched therebetween, the bottom plate 15 is placed on the core member 13 with an adhesive layer 35 sandwiched therebetween, and an inverted lower half mold 42 is put on the bottom plate 15. A stack formed thus superposing the upper half mold 33, the top plate 14, the core member 13, the bottom plate 15 and the bottom half mold 42 is surrounded by frame members 36 and covered with a vacuum bagging film 37. A space covered with the vacuum bagging film 37 is evacuated and the adhesive layers 34 and 35 are precured by hot setting or room temperature setting to complete a structure. The plane shape of the thus constructed structure is not the same as that of the snowboard, and the structure is formed in dimensions according to the dimensions of a plurality of snowboards. The structure is cut into workpieces of a size according to that of the snowboard, the workpieces are trimmed to form core structures 11.

Figure 6:
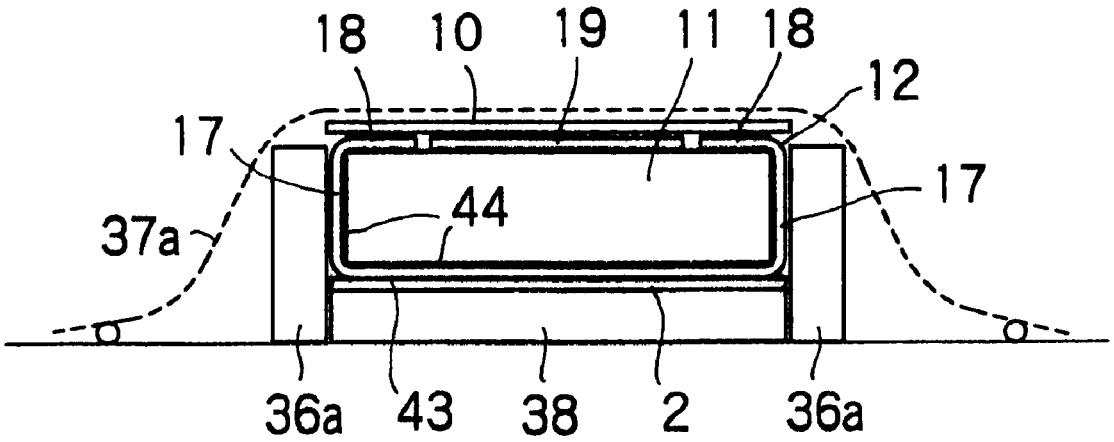
FIG. 6 is a sectional view used to assist in explaining a molding procedure for forming a wrapped structure included in the gliding board of the present invention.

Then, as shown in FIG. 6, the top surface member 2 is placed with its outer surface facing down on an upper half mold 38 set with its forming surface facing up, and the wrapping member 12 prepared by cutting a 0°/90° fabric prepreg sheet in a predetermined width is placed on the top surface member 2 with an adhesive layer 43 sandwiched therebetween. An adhesive layer 44 is formed on a surface of the wrapping member 12 opposite the surface of the same in contact with the top surface member 2. The direction of extension of the wrapping member 12 and the number of the wrapping members 12 are dependent on the requirements of the snowboard. Then, the core structure 11 is placed on the wrapping member 12, the wrapping member 12 is folded so as to wrap the core structure 11 to form the side walls 17 and the bottom walls 18.

The bottom member 19 formed by cutting a 0°/90° fabric prepreg sheet is inserted between the bottom walls 18 of the wrapping member 12 wrapping the core structure 11. The cushioning member 10 prepared by cutting a 0°/90° glass-fiber-reinforced prepreg sheet is placed on the thus formed wrapped structure 4, the combination of the wrapped structure 4 and the cushioning member 10 is surrounded by framing members 36*a*, the combination of the wrapped structure 4 and the cushioning member 10, and the framing members 36*a* are covered with a vacuum bagging film 37*a*, a space covered with the vacuum bagging film 37*a* is evacuated, and the core structure 11, the wrapping member 12, the bottom member 19 and the cushioning member 10 are joined together by hot setting. Then, as shown in FIG. 7, a guide hole is formed through the precured synthetic resin forming the metal anchor member holding part 40 and the top surface member 2, a metal anchor member receiving hole for receiving a metal anchor member 41 is formed by machining the metal anchor member holding part 40 using the guide hole from the side of the bottom surface, and the metal anchor member 41 is fitted in the anchor member receiving hole and is bonded to the anchor member holding part 40. Then, the assembly of the core structure 11, the wrapping member 12, the bottom member 19 and the cushioning member 10 thus formed is placed on the upper half mold 38, and the sole structure 3 is bonded to the cushioning member 10. When bonding the sole structure 3 to the cushioning member 10, an adhesive is applied to the cushioning member 10, the inverted sole structure 3 is joined to the cushioning member 10, the assembly and the sole structure 3 are covered with a vacuum bagging film, a space covered with the vacuum bagging film is evacuated and the adhesive is precured by room temperature setting or hot setting.

The longitudinal bending rigidity of the thus constructed snowboard 1 is exercised by the top surface member 2, the top wall of the wrapping member 12, the top plate 14 of the core structure 11, the sole structure 3, the cushioning member 10, the bottom walls 18 of the wrapping member 12, the bottom member 19 and the core member 13 of the core structure 11, which are disposed at appropriate distances from each other and hence the longitudinal bending rigidity of the snowboard 1 can easily be adjusted to a value equal to a longitudinal bending rigidity of the conventional snowboard.

Since the core structure 11 is substantially a hollow structure and is not provided with any side walls, the snowboard 1 has a relatively low longitudinal torsional rigidity. The longitudinal torsional rigidity of the snowboard 1 can be adjusted by properly determining the quality and dimensions of the side walls 17 of the wrapping member 12.

Since the core member 13 of the core structure 11 has the shape of a trapezoidal or rectangular waveform, the snowboard 1 has a relatively high lateral rigidity. Since a large bonding area is available for bonding the top plate 14 and the bottom plate 15 to the core member 13, the components of the core structure can be bonded together with high bonding strength.

Figure 8:
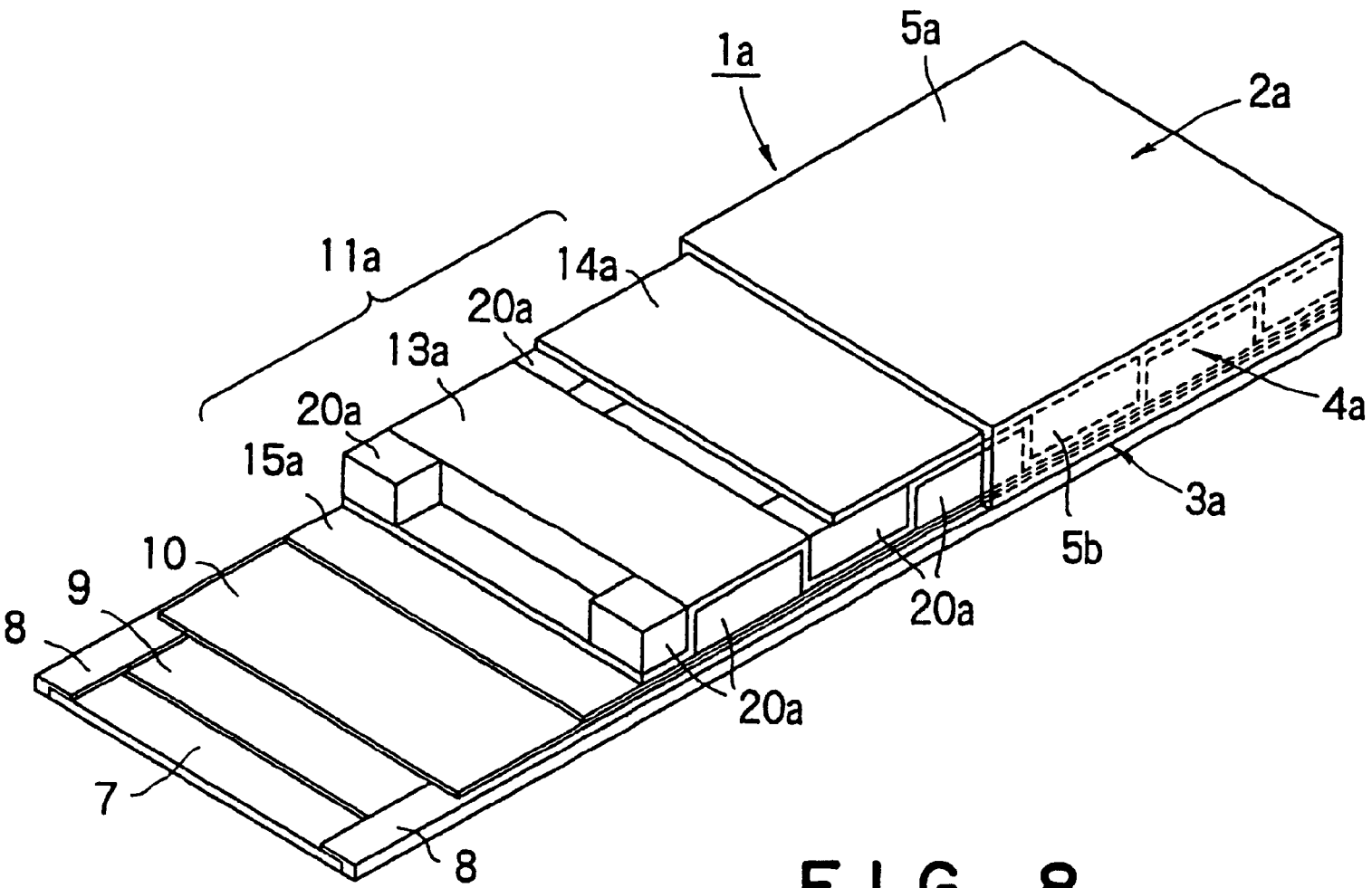
FIG. 8 is a partly removed perspective view of a gliding board in a second embodiment according to the present invention.

Referring to FIG. 8, a snowboard la in a second embodiment according to the present invention does not have any components corresponding to the wrapping member 12 and the bottom member 19 of the snowboard shown in FIG. 1, and has a core member 13*a* provided along its opposite sides with side members 20*a* of a synthetic resin, and a top surface member 2*a* having top surface wall 59, side walls 5*b*.

When fabricating the snowboard 1*a*, the core member 13*a* is constructed by forming a corrugated part, connecting the side members 20*a* to the opposite sides of the corrugated part by an adhesive, and bonding the side members 20*a* to the corrugated part by curing the adhesive. Members of a synthetic resin formed in a desired shape may be bonded to the corrugated part by an adhesive. A prepreg sheet for forming a cushioning member 10 is laminated to a bottom plate 15*a* to unite together the cushioning member 10 and the bottom plate 15*a*.

A core structure of a light metal, such as aluminum or titanium, similar to the core structure 11 or the core structure 11*a* is constructed by a method similar to that of constructing the core structure 11 or 11*a*. A core member, a top surface plate and a bottom surface plate are formed by working a light metal flat plate, and the core member, the top surface plate and the bottom surface plate are joined together by welding or adhesive bonding to construct the core structure of a light metal.

Sometimes, the core member having a hollow inside exhibits resonance. The resonance of the core member can be suppressed and vibrations of the gliding board can be absorbed by coating the core member with foam urethane, rubber or felt or applying sheets of foam urethane, rubber or felt to the core member.

As is apparent from the foregoing description, the gliding board in accordance with the present invention has the core structure constructed by bonding the top and the bottom plates to the top and the bottom surfaces of the core member having a shape of a trapezoidal or rectangular waveform waving forwardly and rearwardly in the longitudinal direction respectively. Therefore, the gliding board, as compared with the conventional gliding board, has a similar longitudinal bending rigidity compared to those of conventional gliding boards, a relatively small longitudinal torsional/bending rigidity ratio and a relatively high lateral bending rigidity. Therefore, the gliding board of the present invention is capable of securing stable edge hold performance and of contacting the undulations of the snow surface. Thus, the gliding board of the present invention can insure a stable gliding performance.

In the gliding board of the present invention, the top plate and the bottom plate can be bonded to the core member with an enhanced bonding strength.

What is claimed is:

1. A gliding board, comprising:

a surface member;

a sole structure; and a core structure formed between the surface member and the sole structure, wherein said core structure having:

a core member formed as a waveform having a ridge portion and a furrow portion, wherein said core member extends along a lengthwise direction of the gliding board, said waveform is arranged at different pitches along the longitudinal direction, and said pitches are reduced from a central part toward both ends of said gliding board so as to obtain a uniform lateral bending rigidity over the entire longitudinal length of said gliding board, a top plate bonded to said ridge portion of said core member, and a bottom plate bonded to said furrow portion of said core member.

2. The gliding board according to claim 1, wherein said waveform is continuously formed with a height determined based on a thickness of said board structure.

3. The gliding board according to claim 1, further comprising:

a wrapping member formed as fiber-reinforced plastic for wrapping around said core structure so as to adjust the longitudinal bending rigidity, a torsional rigidity and the lateral bending rigidity.

4. The gliding board according to claim 1, further comprising:

a plurality of synthetic resin blocks inserted between said surface member and said sole structure at both sides of said core member.

5. The gliding board according to claim 1, wherein said waveform is formed as trapezoidal shape having a top surface and bottom surface of said trapezoidal to be used as bonding area for bonding said top plate and said bottom plate to said core member.

6. The gliding board according to claim 1, wherein said waveform is formed as rectangular shape having a top surface and bottom surface of said rectangular shape to be used as bonding area for bonding said top plate and said bottom plate to said core member.

7. The gliding board according to claim 1, further comprising:

a metal anchor member holding part provide between an inside of said ridge portion and said bottom plate; and a metal anchor member fitted in a space defined in said metal anchor member holding part.

8. A gliding board, comprising:

a surface member;

a sole structure; and a core structure between the surface member and the sole structure, wherein said core structure having a core member formed as a rectangular shaped waveform having a ridge portion and a furrow portion, and a bonding area on a top surface of said ridge portion and a bottom surface of said furrow portion, wherein the waveform waving forwardly and rearwardly in the longitudinal direction of the gliding board, and a bottom plate bonded to said core member at said bonding area of said furrow portion.

9. A gliding board, comprising:

a surface member;

a sole structure; and a core structure between the surface member and the sole structure, wherein said core having a core member formed as a trapezoidal shaped waveform having a ridge portion and a furrow portion, and a bonding area on a top surface of said ridge portion and a bottom surface of said furrow portion, wherein the waveform waving forwardly and rearwardly in the longitudinal direction of the gliding board, and a bottom plate bonded to said core member at said boding area of said furrow portion.

10. A gliding board, comprising:

a surface member;

a sole structure; and a core structure between the surface member and the sole structure, wherein said core member formed as a rectangular shaped waveform having a ridge portion and a furrow portion, and a bonding area on a top surface of said ridge portion and a bottom surface of said furrow portion, said waveform waving forwardly and rearwardly in the longitudinal direction of the gliding board, and a bottom plate bonded to said core member at said bonding area of said furrow portion.

11. A gliding board, comprising:

a surface member;

a sole structure; and a core structure between the surface member and the sole structure, wherein said core structure having a core member formed as a trapezoidal shaped waveform having a ridge portion and a furrow portion, and a bonding area on a top surface of said ridge portion and a bottom surface of said furrow portion, said waveform waving forwardly and rearwardly in the longitudinal direction of the gliding board, and a bottom plate bonded to said core member at said bonding area of said furrow portion.

* * * * *